United States Patent [19]

Eyssa

[11] Patent Number: 4,796,511

[45] Date of Patent: Jan. 10, 1989

[54] ELECTROMAGNETIC PROJECTILE LAUNCHING SYSTEM

[75] Inventor: Yehia M. Eyssa, Madison, Wis.

[73] Assignee: Wisconsin Alumni Research Foundation, Madison, Wis.

[21] Appl. No.: 768,017

[22] Filed: Aug. 21, 1985

[51] Int. Cl.[4] ..... F41F 1/02

[52] U.S. Cl. ..... 89/8; 124/3; 310/12

[58] Field of Search ..... 89/8; 124/3; 310/12-14; 318/135; 336/DIG. 1

[56] References Cited

U.S. PATENT DOCUMENTS

| | | | |
|---|---|---|---|
| 1,370,200 | 3/1921 | Fauchon-Villepleé | 310/13 X |
| 1,421,435 | 7/1922 | Fauchon-Villeplee | 89/8 |
| 3,126,789 | 3/1964 | Meyer | 89/8 |
| 4,343,223 | 8/1982 | Hawke et al. | 89/8 |
| 4,347,463 | 8/1982 | Kemeny et al. | 89/8 |
| 4,423,662 | 1/1984 | McAllister | 89/8 |
| 4,429,613 | 2/1984 | Deis et al. | 89/8 |
| 4,430,921 | 2/1984 | Hughes et al. | 89/8 |
| 4,432,333 | 2/1984 | Kurherr | 89/8 |
| 4,433,608 | 2/1984 | Deis et al. | 89/8 |
| 4,437,383 | 3/1984 | Deis et al. | 89/8 |
| 4,449,441 | 5/1984 | McAllister | 89/8 |
| 4,467,696 | 8/1984 | McNab et al. | 89/8 |
| 4,480,523 | 11/1984 | Young et al. | 89/8 |
| 4,577,545 | 3/1986 | Kemeny | 89/8 |
| 4,608,908 | 9/1986 | Carlson et al. | 89/8 |

OTHER PUBLICATIONS

Homan, et al., "Evaluation of Superconducting Augmentation on Rail Gun Systems", IEEE Transactions on Magnetics, vol. Mag—20, No. 2, Mar., 1984, pp. 366-369.

Fikse, et al., "The ELF—I Augmented Electromagnetic Launcher", IEEE Transactions on Magnetics, vol. Mag.—20, No. 2, Mar. 1984, pp. 287-290.

Benford, et al., "High Energy Rail Gun Designs", IEEE Transactions on Magnetics, vol. Mag—20, No. 2, Mar., 1984, pp. 407-410.

*Primary Examiner*—Stephen C. Bentley

*Attorney, Agent, or Firm*—Isaksen, Lathrop, Esch, Hart & Clark

[57] ABSTRACT

An electromagnetic projectile launcher has a barrel (10) formed with parallel firing rails (13, 14) and separate supply conductors (18, 19) which are connected to the firing rails to supply firing current to one and receive the firing current from the other. The supply conductors (18, 19) are formed about the bore (11) of the barrel as sectors of a cylinder and are coaxial with one another such that current in adjacent portions of the two supply conductors flow in opposite directions. Very little time varying magnetic field is produced within the bore of the barrel (11) or outside of the supply conductors (18, 19) as a result of firing currents flowing in the supply conductors and in the firing rails. The magnetic field which accelerates a projectile through the bore is provided from a persistent magnet (26), which may be superconducting, formed about the bore in a dipole configuration to provide a constant magnetic field substantially transverse to the path of the projectile through the barrel.

16 Claims, 1 Drawing Sheet

ELECTROMAGNETIC PROJECTILE LAUNCHING SYSTEM

FIELD OF THE INVENTION

This invention pertains generally to electromagnetic projectile launchers or rail guns and to the construction of the barrels for such launchers.

BACKGROUND ART

A primary objective of electromagnetic launcher design is to maximize efficiency while minimizing the complexity, mass and expense of the structure. In the context of electromagnetic launch technology, efficiency may be defined in terms of the relative amount of kinetic energy supplied to a projectile compared to the energy supplied by a source to launch the projectile. A more efficient rail gun design will normally require a smaller, lighter and less expensive energy source than a less efficient rail gun. Weight considerations for the total system comprised of both the rail gun and its source are particularly important for launcher systems that are intended to be orbited in space.

Several rail gun designs have been developed which have different efficiencies and degrees of complexity. The simplest rail gun system consists of two conducting rails which carry current to a conducting element or plasma at the rear of a projectile. The efficiency of this simple type of rail gun system is very poor, generally in the range of ten to thirty percent. More advanced concepts include self-augmenting rails, for example as shown in U.S. Pat. No. 4,347,463 to Kemeny, et al., segmented distributed energy-storage rails, and non-segmented distributed energy storage rails. These more complex systems are capable of achieving energy efficiencies in the forty to sixty percent range.

There are three main sources of energy loss in an electromagnetic launcher system the resistive losses in the firing rails, the loss in the plasma behind the projectile, and the loss of the energy stored in the magnetic field from the rail current, which is typically dissipated in muzzle resistors. The relative efficiency of a rail gun at a particular level of firing currents applied to the rails can be improved by increasing the magnetic field through which the projectile moves. Augmenting coils connected in series with the firing rails have been proposed and would carry millisecond pulses of the very large currents which are required by the firing rails. The augmenting coils are of normal metal conductors, typically copper or aluminum, and thus resistively dissipate some of the energy from the source.

Superconductive coils cannot be used for augmenting coils because the pulsed firing currents would drive the superconductive coils into the nonsuperconducting normal state. It has also not been feasible to use superconductive coils driven with constant current which would serve to provide the persistent magnetic field through which the projectile could be driven. The pulsed armature current passing through the firing rails and the plasma between them create magnetic field pulses, which, if applied to the superconducting coil, would drive the superconductor to a normal conducting state. Although superconducting coils could theoretically be shielded from the time varying magnetic fields, the size, weight, and expense of the shielding required, plus substantial eddy current loss, renders such a solution impractical.

SUMMARY OF THE INVENTION

In accordance with the present invention, an electromagnetic projectile launching system is provided in which a coil separate from the firing rails provides the magnetic field through which the projectile is accelerated. Two firing rails extend generally parallel to one another along the length of the projectile path. A first supply conductor is electrically connected and disposed generally parallel to the first rail and partly surrounds the projectile path. A second supply conductor is electrically connected and disposed generally parallel to the second rail and is spaced outwardly of and generally coaxial with the first conductor. Preferably, the first and second conductors have two semi-cylindrical portions which are disposed on either side of the projectile path between the firing rails and in generally coaxial relationship to one another.

A source of high current is connected between the first and second conductors which provides a pulse of current through the first supply conductor and thence to the first firing rail. The current passes through the plasma behind the projectile to the second rail and thence to the second supply conductor and back to the source. Because the first and second supply conductors are coaxially arranged, current will be flowing down the barrel of the launcher in one direction in adjacent portions of the first conductor and flowing in the opposite direction in the coaxially spaced second conductor. Consequently, the magnetic fields from the currents in the first and second supply conductors will be substantially confined to the space between the conductors, and very little magnetic field from the firing currents will exist in the space outwardly or inwardly of the supply conductors. Neither the projectile and the plasma behind it nor the external coil producing the persistent magnetic field will experience a substantial pulsed magnetic field from the currents flowing through the first and second supply conductors during firing.

Because the external coil experiences no substantial magnetic pulse, it can be formed of superconducting material and maintained at superconducting temperatures. The energy stored in the magnetic field in the superconducting coil which is required to produce the accelerating magnetic field will thus persist after the projectile has exited, in contrast to conventional launch systems in which the energy stored in the magnetic field developed from the current passing through the firing rails must be dissipated in muzzle resistors after each shot. Furthermore, since the necessary high magnetic field is developed in the external coil, the firing rails can be sized and arranged to provide a lower resistance. The current that must be supplied to the firing rails to achieve a desired acceleration of the projectile can also be reduced from that possible with conventional systems by increasing the magnetic field from the external coil. Utilizing superconducting external coils, such high magnetic fields can be achieved with relatively low loss.

Another major advantage of the coaxial supply conductor arrangement in accordance with the present invention is that current can be supplied to and drawn from the conductors at both ends of the barrel, since it is not necessary for the current flowing through the firing rails to produce the magnetic field which drives the projectile. For example, one terminal of the source may be connected to the first supply conductor at both ends of the barrel to supply current to both ends. The other terminal of the source may be connected to the second supply conductor at both ends of the barrel to receive current from the second conductor. During acceleration of the projectile, current flows from both ends of the barrel through the first conductor to the point on the firing rail to which the first conductor is connected at which the plasma behind the projectile is located. Similarly, the current flowing into the second firing rail flows therefrom to the second supply conuctor and thence to both ends thereof to return to the source. By supplying the first and second supply conductors in this manner, the size and mass of the supply conductors and the firing rails taken together need not be as great as the size of firing rails which must carry the full firing current in a single direction.

To minimize the current flowing through the firing rails in a direction parallel to the path of the projectile, the firing rails may be segmented into a plurality of sections which are electrically insulated from one another. In this manner, substantially all of the current flowing generally parallel to the path of the projectile will be confined to the coaxial supply conductors. The external persistent field coil can also be divided into several parts rather than being formed as a single dipole extending over the entire length of the barrel. For example, the coil could be formed as several separate coils each a few meters long. The construction of such coils could also be varied along the length of the launcher such that the field from the separate coils would increase along the length of the launcher to compensate for drops in the plasma current, thereby maintaining a substantially constant accelerating force on the projectile.

Further objects, features, and advantages of the invention will be apparent from the following detailed description when taken in conjunction with the accompanying drawings.

DESCRIPTION OF THE PREFERRED EMBODIMENT

Figure 1:
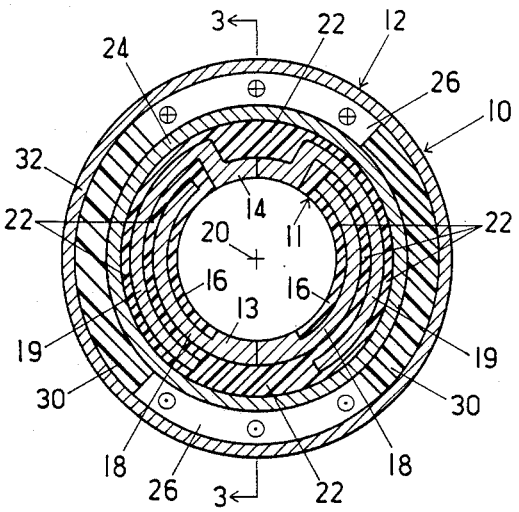
FIG. 1 is a cross-sectional view through the barrel of an electromagnetic launcher of the invention.

For purposes of illustration, a cross-sectional view of an exemplary embodiment of a barrel for an electromagnetic launcher is shown generally at 10 in FIG. 1. The barrel 10 has a circular inner bore 11 and outer circumference 12, although it is apparent that other geometrical configurations (e.g., a rectangular bore) are possible and in some cases desirable.

Figure 2:
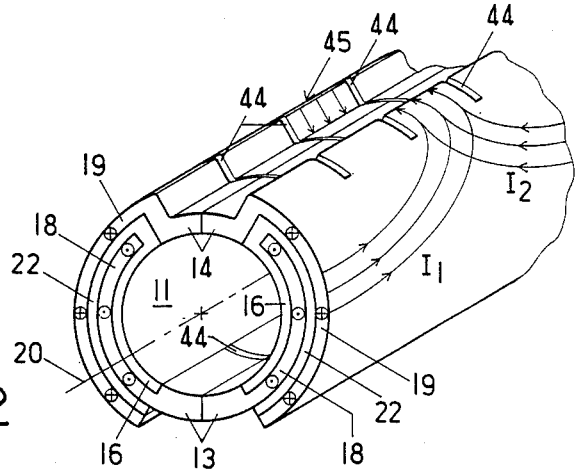
FIG. 2 is a perspective view of the coaxial conductors and firing rails of the barrel of FIG. 1 shown in isolation for better illustration.

The barrel 10 has a first firing rail 13 extending over a portion of the circumference of the inner bore 11 and a second firing rail 14 similarly extending over a portion of the inner bore at a position diametrically opposite that of the firing rail 13. The rails 13 and 14, formed of a normal conducting metal such as copper, aluminum, or various conductive alloys, extend the length of the barrel 10 and are exposed to the projectile which is accelerated through the barrel and the plasma which drives it. The electron flow through the plasma during the firing of a projectile passes from the first rail 13 to the second rail 14 (i.e., in conventional notation, current flows from the second rail 14 to the first rail 13), and progresses along the length of the barrel as the projectile is accelerated. Between the positions of the exposed portions of the rails 13 and 14, layers 16 of high strength low conductivity insulating material are formed. For convenience in construction and assembly of the barrel, the rails 13 and 14 may be formed of two pieces extending the length of the barrel which are butted together at a joint, as illustrated in the views of FIG. 1 and 2.

The first firing rail 13 is supplied with firing current from a first electrical supply conductor 18 which is preferably integrally connected to the firing rail 13, extends along the length of the barrel 10, and is formed of two segments on opposite sides of the bore 11 which are sectors of a circular cylinder. A second electrical supply conductor 19 is connected preferably integrally, with the firing rail 14, extends the length of the barrel 10, and is formed in two segments comprising sectors of a circular cylinder which are concentric with and spaced outwardly from the cylindrical segments of the conductor 18. The first and second supply conductors 18 and 19 are thus coaxial with each other with respect to the central axis 20 of the bore 11. The concentric conductors 18 and 19 are also preferably formed of normal conducting metal, such as the copper or aluminum of which the firing rails 13 and 14 are formed. The conductors 18 and 19 are separated and electrically isolated from one another by a layer 22 of insulating material. The insulator 22 also preferably is formed around the outer periphery of the second or outer supply conductor 19 and over the outer areas of the firing rails 13 and 14. A cylinder or ring 24 of high strength structural material, such as steel, is mounted about the insulator 22 and preferably in tight contact therewith. The structural ring 24 serves to resist the strong outward pressure forces exerted on the firing rails 13 and 14 and the supply conductors 18 and 19 during the firing of a projectile.

The magnetic field through which the projectile (not shown) is accelerated is provided by a magnet which is independent of and not electrically connected to the firing rails 13 and 14, in contrast to the usual arrangement for augmenting coils. As illustrated in FIG. 1, the persistent magnet may be formed as a dipole coil 26 wound outside the supporting structure 24 on opposite sides of the bore 11. As illustrated in FIG. 1 in lateral cross section, and in the longitudinal cross-sectional view of FIG. 3, the current $I_p$ in the external magnetic coil 26 flows in opposite directions in the two opposed segments of the coil 26. A net magnetic field is thus formed by the coil 26 which passes through the bore 11 in a direction transverse to the longitudinal axis 20 and normal to the plasma current. The coil 26 may be formed of a normal conducting material, such as high purity aluminum (maintained in liquid hydrogen, if desired, to obtain highest conductivity). However, the magnet 26 is preferably a superconducting magnet having turns of a composite of superconducting material and normal conducting material formed and cooled in a conventional fashion. As explained further below, because of the coaxial arrangement of the supply conductors 18 and 19, very little time varying magnetic field will be experienced by the turns of the coil 26, thereby allowing superconducting material to be utilized for the persistent coil and obtaining the well known efficiency advantages of superconducting coils over normal conductors.

Figure 3:
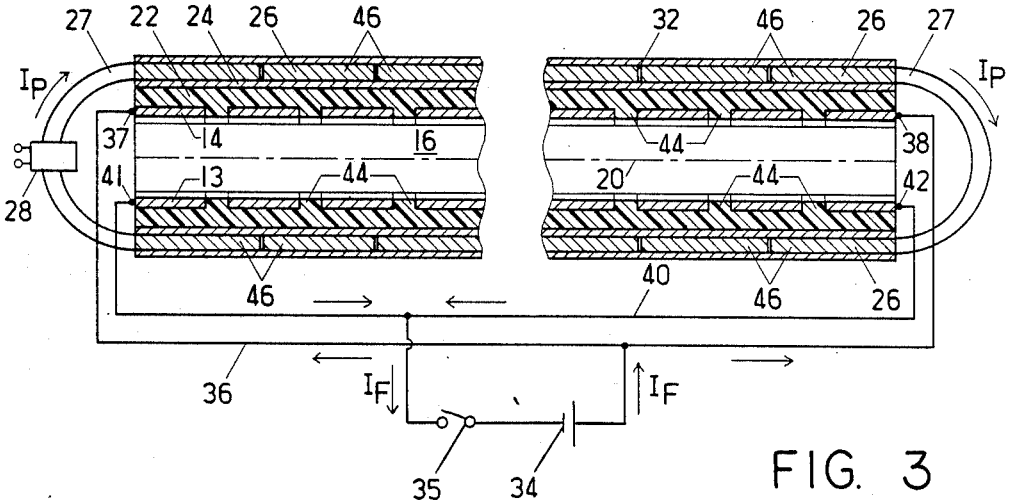
FIG. 3 is a cross-sectional view down the length of the barrel of FIG. 1 taken generally along the lines 3—3 of FIG. 1 and showing schematic circuit connections thereto.

As illustrated schematically in FIG. 3, connecting links 27, preferably also of superconducting material maintained at superconducting temperatures, conducts the current from one side of the magnet coil in the barrel to the other. The connecting links would conveniently be formed along the outside of the barrel and are shown in FIG. 3 in extended position for aid in illustration. Electrical energy may be supplied to or withdrawn from the superconducting coil 26 by various means, an interface device being illustrated at 28 in FIG. 3. Examples of power supplies which may be utilized to interface a power source with the superconducting coil are illustrated, for example, in U.S. Pat. Nos. 4,079,305 entitled Power Supply for High Power Loads, and No. 4,122,512 entitled Superconductive Energy Storage for Power Systems.

The sections of the magnet 26 in the barrel are isolated from each other by insulating sections 30, and the entire structure is surrounded and reinforced by a cylindrical ring 32 of structural material, e.g., steel, which further serves to resist the self-induced, outwardly directed magnetic pressure on the coil 26.

It may be seen from an examination of FIGS. 1 and 2 that if all of the firing currents conducted along the axis of the barrel are conducted in the first supply conductor 18 in one direction and by the coaxial second supply conductor 19 in the other direction, with the magnitudes and distribution of the currents in adjacent portions of the two conductors being substantially equal, the magnetic fields from each of the segments of the conductors 18 and 19 will be substantially confined to the space between the adjacent concentric conductors and very little net magnetic field will be experienced within the bore 11 as a result of currents carried by the conductors 18 and 19. The firing current may be supplied to the conductors 18 and 19 at both ends of the barrel, if desired, as illustrated in FIG. 3, in which the source of electrical power is illustrated at 34 and a firing switch at 35. Of course, two separate power sources could be used to supply current to opposite ends of the barrel. A first conducting line 36 directs the firing current to the outer supply conductor 19 at connection points 37 and 38 located at opposite ends of the barrel. It is understood that the connections shown in FIG. 3 are schematic only, and the conducting lines 36 would be relatively larger and the connections 37 and 38 would preferably be made by conductors which are attached to the ends of the cylindrical conductor 19 over a substantial portion, if not the entire cross-section of the conductor at the end of the barrel. Similarly, a conducting line 40 returns the firing current from connections 41 and 42 made to the inner supply conductor 18 at opposite ends of the barrel. As above, the connections 41 and 42 are shown schematically only, it being understood that these would preferably extend over a substantial portion of the cross-section of each segment of the conductor 18.

Because substantially equal currents are conducted in opposite directions in the adjacent portions of the supply conductors 18 and 19, such that substantially no magnetic field results therefrom within the bore 11, it is possible to supply current to and withdraw current from both ends of the conductors 19 and 18, respectively. It is not possible to provide current to both ends of the conductors in conventional electromagnetic accelerators since all of the currents flowing must be flowing in a direction such that the magnetic field therefrom acts to accelerate the projectile. As illustrated in FIG. 3, the current flowing through the input conductor 36 will divide between the connections 37 and 38 at opposite ends of the barrel depending, in part, on the position of the projectile within the barrel and the relative resistance of the paths through the conductor 19 to the position of the plasma behind the projectile. Similarly, the current flowing out of the conductor 18 will divide between the connections 41 and 42 based on the relative impedance of the path between these connections to the position of the plasma within the bore 11 of the barrel.

To help insure that the firing current flows substantially only in the supply conductors 18 and 19 along the length of the barrel parallel to the projectile path axis 20, and substantially no current flows along the length of the barrel in the firing rails 13 and 14, the firing rails are preferably segmented in the manner illustrated in FIGS. 2 and 3. The firing rails are divided along their lengths into segments separated by gaps 44 which are filled with an insulating material, preferably formed integrally with the insulator 22. As illustrated in FIG. 2, currents $I_1$ and $I_2$ flowing from opposite ends of one segment of the conductor 19 will flow generally parallel to the central axis 20 until reaching the position of the particular segment 45 of the rail 14 at which the plasma behind the projectile is instantaneously located. At the position of this segment, the current will flow inwardly toward the segment 45 of the firing rail 14 and thence across the bore through the plasma to the corresponding segment of the firing rail 13, which is similarly separated by insulated gaps 44. As the projectile moves down the length of the barrel, the current flowing through the supply conductors 18 and 19 will quickly switch from segment to segment of the rails 13 and 14.

The superconducting dipole magnet 26 produces a substantially uniform cross-field over the barrel bore 11, the firing rails 13 and 14, the supply conductors 18 and 19, and the ancillary supporting structure. As an example, a superconducting dipole can readily produce a field of 8 tesla across a bore 20 centimeters in diameter which is maintained at room or ambient temperature. In the zero gravity environment of space, superfluid helium (He II) at 1.8° K. is convenient for cooling of the composite conductors. At a temperature of 1.8° K., a niobium-titanium superconductor can be utilized to produce fields up to 10 tesla with a 50 percent greater current capacity than the same conductors at 4.2° K., thereby reducing mass of the conductor to a minimum. Since the superconducting coil will be operated in the persistent current mode, and is not inductively coupled to the firing rails, its helium usage is small. The coil current is preferably made as small as practical, e.g., 100 to 1,000 amperes, to help reduce cryogenic lead losses. Preferably the winding across the angular span of the segments of the superconductor 26 within the barrel can be formed to approximate a cosine distribution to enhance the distribution of the magnetic field within the bore. If desired, the coil 26 can be subdivided into a number of subcoils 46, illustrated in FIG. 3, with connecting leads (not shown) extending about the circumference of the barrel from each of the segments 46 on opposite sides of the bore so that each opposed segment 46 together with its connecting leads forms a separate dipole. Each dipole can then be connected in series so that the same current runs through each, or the separate coil segments can be separately supplied with current.

The coil segments can be formed such that the field from the coils could increase progressively along the length of the barrel so that as the plasma armature current drops, the accelerating force on the projectile would remain substantially constant. Separate coil parts are of particular advantage in very long barrels since the coil parts could be formed as individual coils a few meters long rather than requiring a unitary superconducting coil having a coil turn length many tens of meters long.

It is also possible to obtain fields greater than 8 tesla and up to 12 tesla using niobium-titaium superconductors at 1.8° K. temperature. The higher the field applied by the external magnet, the lower the firing rail currents which are needed to provide a selected projectile acceleration, thereby allowing even greater efficiency by reducing the resistive losses in the firing rails and allowing smaller and simpler firing rail construction.

Because the firing currents produce substantially no magnetic field inside the bore 11 or outside of the outer supply conductor 19, the opertion from the energy of the firing current which is stored in the magnetic field is minimized. In conventional rail gun structures, the very substantial magnetic field energy from the firing current is usually dissipated in a muzzle resistor. In the barrel of the present invention, the cross section of the supply conductors 18 and 19, and of the firing rails 13 and 14, can be made large enough to reduce resistive losses without reducing driving force on a projectile, an inevitable consequence of increasing firing rail cross section in conventional rail gun designs. In addition, because the current can be supplied from both directions through the supply conductors, the resistive losses in the supply conductors and firing rails is reduced over conventional designs and less structural support for the firing rails is needed since they are not carrying as great a current through the magnetic field.

The field from the current in the supply conductors 18 and 19 and the rails 13 and 14 does not produce a net force on the plasma armature which drives the projectile. The magnetic flux lines produced by the current pattern in the supply conductors are largely contained inside the thin region between the inner and outer conductors 18 and 19, with very small fields existing outside the barrel regions due to currents in the supply conductors. More specifically, for a plasma length nD (D is the diameter of the bore 11 and n is a factor which can be determined in a conventional manner for a particular bore diameter) and where I is the total current through the plasma, the axial field B inside the plasma is $$B = \frac{\mu_o I}{2nD}$$

where $\mu o$ is the permeability of the bore space (e.g., vacuum). The magnetic energy $E_m$ stored per unit length of the barrel is $$E_m = \frac{\mu_o I^2}{32n^2},$$

for n greater than 1.

The efficiency of the barrel structure 10 may be exemplified by considering the acceleration of a 1 kilogram projectile to a muzzle velocity of 10 kilometers per second. An average plasma current of 1.5 megamperes over a 40 meter long rail gun using a 7 tesla external field is required to achieve this exit velocity, in accordance with the expression $$V = \sqrt{\frac{2DBIL}{m}}$$

where v is the exit velocity, m is the mass of the projectile, D is the bore diameter, B is the external field produced by the persistent coil 26, and L is the length of the barrel. For a relative plasma length n=4 to 10, $E_m$ is 1.6 at $10^4$ to $0.3\times10^4$ Joules/meter. The total loss of energy in the time varying magnetic field is thus 0.64 megajoules for n=4, with all of this energy being lost along the 40 meter length of the barrel. Other losses are the resistance heating in the supply conductors and in the rails and the loss of the energy stored in the magnetic field which is confined between the supply conductors. For a 10 centimeter diameter barrel, it may be shown that the inductance per unit length of the supply conductors and rails is approximately equal to 0.06 microhenries per meter, which yields a magnetic energy loss of 0.0125 megajoules per meter or 0.5 megajoules for the total 40 meter length. Thus, the total magnetic energy loss for a 40 meter barrel is less than 3 megajoules. This compares to losses in the range of 20 megajoules which would occur in a simple rail gun design having two unaugmented firing rails. The estimated total resistance loss in the supply conductors 18 and 19 and the firing rails 13 and 14 for the full 40 meter barrel length is approximately 6 megajoules. For a typical 1 kilovolt voltage drop in the plasma, the plasma losses will be approximately 6 megajoules. The total losses from plasma, resistance and magnetic energy is projected to be 13 to 15 megajoules to accelerate a projectile to 50 megajoule energy level, an efficiency of nearly 80 percent. Such efficiency is not realizable with either a single stage rail gun or an augmented rail gun with distributed energy storage for which full recovery of magnetic energy is theoretically possible. In practice, about ten distributed energy storage systems would be required to achieve comparable efficiency.

It is understood that the invention is not confined to the particular construction set forth herein, but embraces such modified forms thereof as come within the scope of the following claims.

What is claimed is:

1. An electromagnetic projectile launcher comprising:

(a) a pair of electrically conductive firing rails disposed generally parallel to one another to define a projectile path between them;

(b) electrical coil means formed outwardly of the firing rails for producing, when current is flowing therethrough, a magnetic field transverse to the projectile path between the firing rails;

(c) first and second supply conductors disposed outwardly of the firing rails, one of the conductors connected to one of the firing rails and the seocnd conductor connected to the other firing rail along the lengths thereof, the first and second supply conductors formed as sectors of a cylinder and disposed generally parallel to and coaxial with each other with respect to the projectial path.

2. The electromagnetic projectile launcher of claim 1 wherein the electrical coil includes superconductive windings.

3. The electromagnetic projectile launcher of claim 1 wherein each of the firing rails are divided into a plurality of segments along the length of the projectile path which are electrically insulated from one another by electrical insulation material and wherein the supply conductors are connected to the firing rails to supply current thereto or receive current therefrom whereby current flows in the segments of firing rails to and from the supply conductors substantially transverse to the projectile path and such that current flows in the supply conductors substantially parallel to the projectile path.

4. The electromagnetic projectile launcher of claim 1 including a source of electrical power connected to the electrical coil means to supply the same with electrical power to provide a substantially constant current flow therein and thereby to produce a substantially constant magnetic field transverse to the path of the projectile.

5. The eleotromagnetic projectile launcher of claim 1 inlcuding a source of high current electrical power connected to supply current to one of the supply conductors and to receive current from the other of the supply conductors.

6. An electromagnetic projectile launcher barrel comprising:

(a) a pair of firing rails disposed generally parallel to one another to define a projectile path between them;

(b) a first supply conductor integrally connected with one of the firing rails and having two cylindrical segments extending away from the firing rail partially around the projectile path defined between the firing rails;

(c) a second supply conductor integrally connected to the other of the firing rails and having two cylindrical segments extending away from the firing rail partially around the projectile path and disposed in spaced relation to and coaxially with the segments of the first supply conductor;

(d) insulating material between the firing rails around the projectile path to thereby electrically insulate the supply conductors from a projectile in the projectile path, and insulating material separating and electrically insulating the supply conductors from one another.

7. The barrel of claim 6 wherein each firing rail is divided into a plurality of segments along the length of the projectile path with each segment being electrically insulated from other segments by electrical insulating material such that electrical current is provided to the firing rails from the supply conductors connected thereto whereby the current flow in the firing rail segments to and from the supply conductors substantially only in a direction which is transverse to the projectile path.

8. The barrel of claim 6 wherein each firing rail is formed of two parts which are joined together at a joint which extends the length of the path of the projectile along the bore of the barrel.

9. The barrel of claim 6 wherein the segments of the supply conductors are formed as sectors of a circular cylinder.

10. The barrel of claim 6 including support material surrounding and structuraly supporting the supply conductors to resist outwardly directed pressure on the supply conductors when current is flowing therethrough.

11. The barrel of claim 6 including an electrical coil having conductors running the length of the barrel on opposite sides of the path of the projectile therethrough and arranged such that current flows in one direction only on each side of the bore of the barrel whereby the magnetic field produced by the conductors in the coil is directed substantially transversely to the projectile path and transversely to current flowing across the projectile path between the firing rails.

12. The barrel of claim 11 wherein the electrical coil has superconducting windings and wherein the firing rails and supply conductors are formed of normal conductivity metal.

13. An electromagnetic projectile launcher comprising:

(a) a pair of firing rails extending generally parallel to one another to define a projectile path between them;

(b) means for producing a magnetic field transverse to the projectile path between the firing rails;

(c) first and second supply conductors extending the length of the projectile path, the first supply conductor connected to one of the firing rails to supply current thereto and the second supply conductor connected to the other of the firing rails to receive current therefrom; and (d) a source of high current electrical power having two terminals with one of the terminals electrically connected to the first supply conductor at both ends of the projectile path and the other terminal electrically connected to the second supply conductor at both ends of the projectile path.

14. An electromagnetrc projectile launcher comprising:

(a) a pair of firing rails extending generally parallel to one another to define a projectile path between them;

(b) means for producing a magnetic field transverse to the projectile path between the firing rails;

(c) first and second supply conductors extending the length of the projectile path, each supply conductor having two segments formed as sectors of a cylinder which are disposed on opposite sides of the projectile path, the segments of the first and second supply conductors being disposed coaxially with one another, the first supply conductor connected to one of the firing rails to supply current thereto and the second supply conductor connected to the other of the firing rails to receive current therefrom.

15. An electromagnetic projectile launcher comprising:

(a) a pair of electrically conductive firing rails disposed generally parallel to one another to define a projectile path between them;

(b) electrical coil means formed outwardly of the firing rails for producing, when current is flowing therethrough, a magnetic field transverse to the projectile path between the firing rails;

(c) first and second supply conductors disposed outwardly of the firing rails, one of the conductors connected to one of the firing rails and the second conductor connected to the other firing rail along the entire lengths of the firing rails, the first and second supply conductors each having two segments formed as sectors of a cylinder which are disposed on opposite sides of the projectile path and integrally connected to the respective firing rail to which it is connected, the segments of the first and second supply conductors being disposed coaxially with one another with respect to the projectile path, and including insulating material disposed to electrically insulate the two supply conductors from one another.

16. An electromagnetic projectile launcher comprising:

(a) a pair of electrically conductive firing rails disposed generally parallel to one another to define a projectile path between them;

(b) electrical coil means formed outwardly of the firing rails for producing, when current is flowing therethrough, a magnetic field tranvere to the projectile path between the firing rails;

(c) first and second supply conductors disposed outwardly of the firing rails, one of the conductors connected to one of the firing rails and the second conductor connected to the other firing rail along the entire lengths of the firing rails, the first and second supply conductors disposed generally parallel to each other and to the projectile path and extending the length of the projectile path; and (d) a source of high current electrical power having two terminals, one of the terminals connected to one of the supply conductors at both ends of the projectile path to supply current thereto and the other of the terminals connected to the other of the supply conductors at both ends of the projectile path to receive current therefrom.

* * * * *

UNITED STATES PATENT AND TRADEMARK OFFICE

CERTIFICATE OF CORRECTION

PATENT NO. : 4,796,511

DATED : January 10, 1989

INVENTOR(S) : Yehia M. Eyssa

It is certified that error appears in the above-identified patent and that said Letters Patent is hereby corrected as shown below:

Col. 7, line 21, "opertion" should read --portion--.

Col. 9, line 18, "eleotromagnetic" should read --electromagnetic--.

Col. 9, line 62, "structuraly" should read --structurally--.

Col. 11, line 12, "tranvere" should read --transverse--.

Signed and Sealed this

Sixth Day of June, 1989

*Attest:*

*Attesting Officer*

DONALD J. QUIGG

*Commissioner of Patents and Trademarks*